US007079045B2

(12) United States Patent
Baud et al.

(10) Patent No.: US 7,079,045 B2
(45) **Date of Patent: *Jul. 18, 2006**

(54) REMOTE CONTROL WITH CHANGE OF OPERATING MODE

(75) Inventors: André Alfred Baud, Ville-la-Grand (FR); Olivier Poulet, Boege (FR)

(73) Assignee: Somfy SAS, Cluses (FR)

( * ) Notice: Subject to any disclaimer, the term of this patent is extended or adjusted under 35 U.S.C. 154(b) by 124 days.

This patent is subject to a terminal disclaimer.

(21) Appl. No.: 10/819,797

(22) Filed: Apr. 7, 2004

(65) Prior Publication Data

US 2004/0222900 A1 Nov. 11, 2004

Related U.S. Application Data

(63) Continuation-in-part of application No. 10/486,006, filed on Feb. 4, 2004.

(30) Foreign Application Priority Data

Aug. 6, 2001 (FR) ..... 01 10486
Jul. 31, 2002 (WO) ..... 03/015049 A1

(51) Int. Cl.
*G08C 19/00* (2006.01)

(52) U.S. Cl. ..... 340/825.72; 340/539

(58) Field of Classification Search ..... 340/825.72, 340/825.69, 539, 565, 539.32; 235/375; 248/176.1; 341/176; 379/110.01, 74; 710/4
See application file for complete search history.

(56) References Cited

U.S. PATENT DOCUMENTS 5,475,382 A * 12/1995 Yuen et al. ..... 340/825.72
5,790,021 A * 8/1998 Mickel et al. ..... 340/539.32
6,522,078 B1 * 2/2003 Okamoto et al. ..... 315/149
6,727,826 B1 * 4/2004 Ki Kwan et al. ..... 340/825.72

* cited by examiner

*Primary Examiner*—Michael Horabik
*Assistant Examiner*—William Bangachon
(74) *Attorney, Agent, or Firm*—Frommer Lawrence & Haug LLP; Ronald R. Santucci

(57) ABSTRACT

A device for controlling a controlled device includes a remote control unit having a transmitter, a processor, a clock connected to the processor, and a control keypad. The remote control unit is removably engageable in a support, and when the remote control unit is in a first position relative to the support, manipulation of the keypad results in sending programming commands to the processor such that the processor can transmit control signals to the controlled device at user-defined times. On the other hand, when the remote control unit is not in the first position relative to the support, manipulation of the keypad causes the transmitter to send commands to the controlled device. Alternatively, when the remote control unit is in the first position relative to the support, the keypad is disabled, such that commands may be sent to the controlled device from the device only automatically at preprogrammed times. When the remote is removed from the support, automatic transmission of preprogrammed commands from the processor can be disabled, such that the only way to remotely control the controlled device using the device is to manipulate the keypad.

12 Claims, 2 Drawing Sheets

REMOTE CONTROL WITH CHANGE OF OPERATING MODE

RELATED APPLICATIONS

The present application is a continuation in part of U.S. patent application Ser. No. 10/486,006, filed Feb. 4, 2004.

BACKGROUND OF THE INVENTION

The present invention relates to a device for the remote control of a comfort management system of so-called home automation type, having at least two operating modes, a first automatic operating mode, and a second manual operating mode, comprising a remote control unit consisting of a box comprising at least one remote control transmitter and a control keypad.

The controlled system consists for example, of a means of a heating and air conditioning device, of a device for moving openable panels or dynamic solar protection, or else of lighting. The systems concerned are to be found in the home, offices or commercial buildings.

It relates more particularly to a device for remote control in which at least two modes of operation are envisaged, a so-called manual mode, in which the device essentially obeys the orders given by a means of manual control, for example a remote control box, and a so-called automatic mode, in which the device essentially obeys the orders of a supervisor program.

The definition of the two modes manual and automatic takes account of inevitable overlaps of functions. For example, although one is in manual mode, it is clear that a properly designed home automation device will not obey an order to raise the heating temperature if it notes that a window is still wide open, or at the least it will react to such an order so as to request confirmation. Another example would be that of automatic control of the lighting, for example as a function of exterior brightness. It is entirely understandable that the user wishes to be able to modify locally the situation managed by the automation mechanism, without however leaving the automatic mode.

Such a situation is described in patent EP 0 521 818 from the applicant: in an automatic operating mode, the orders given by the local means of remote control are interpreted as variations of the set-point of the automation mechanism.

It is in all cases useful for the user to be able to clearly choose the mode, or variant of mode, in which he wishes to see the installation operate.

DESCRIPTION OF THE PRIOR ART

In prior art products, for which the link between the control point and the automation mechanism was a wire link, a simple switch with two positions clearly indicated the situation chosen.

In more recent products, and especially in products marketed by the applicant under the names Centralis or Soliris, this change of mode is effected by a specific pushbutton.

A pushbutton is aesthetically more agreeable than a pull switch. Its use facilitates compliance with any sealing constraints. It is very economical. On the other hand, it does not indicate the state existing after actuation. It must therefore be supplemented with at least one indicator light, such as a light-emitting diode, to indicate this state.

It is clear that in an autonomous remote control device, powered by batteries or the like, the mode indicator light cannot be permanently lit, for simple reasons of consumption. This mode indicator function will therefore be activated at the moment that the user operates one of the control buttons. It is therefore impossible for the user to know, at a single glance, and from a certain distance, which mode this installation is in.

This criticism may moreover be applied in the same way to older devices containing a pull switch or even to a device that contains one or more permanently illuminated light-emitting diodes. The design of the product usually requires that the pull of the switch be discreet, and moreover that the meaning of each position, or of the lit state of an indicator not be written in large characters on the front panel of the remote control product. It is therefore understood that the elderly or those who are simply short-sighted will have difficulty in ascertaining the state of the system, unless they move so as to be as near as possible to the control point.

It is known to bring about a change of mode of a comfort automation mechanism, in particular based on the presence or otherwise of the occupant in the zone managed by the automation mechanism. Numerous patents illustrate such a preoccupation, in particular in respect of lighting or heating applications. Contemporary presence sensors are volumetric sensors employing infrared pyrometric detection, but simple means, based on the use of the insertion of an object that the user will pick up if he leaves the room, are also found.

In American patent U.S. Pat. No. 4,060,123 is described for example a system intended in particular for the heating and/or air conditioning of hotel rooms, in which a support and a detachable element are used. This involves for example the room access key, the placing of which in a position of the support makes it possible to go from an energy saving mode to the normal mode. In contradistinction to the invention, this detachable element is passive.

In American patent U.S. Pat. No. 5,950,722, is described a process for changing manual/automatic operating mode of an automobile air conditioning unit linked with the opening or otherwise of the sunroof by the driver. However, in this patent, the device does not employ a remote control.

International patent application WO 00/17737 describes a remote control system whose user interface depends on the position of said remote control unit in the house or its environment. Each room of the house is equipped with fixed transmitters, having different identifiers. The remote control unit contains a transmitter receiver, in such a way as to be able to communicate with an information source. The remote control unit is informed of its position, for example by virtue of an internal sensor which detects the close transmission of the fixed transmitter, placed in the room in which the remote control unit is located. By addressing itself to the information source, the remote control unit gathers the data relating to the appliances (lamps, domestic appliances, etc.) that it is able to control in said room. These appliances appear for example in the form of pictograms on a touch screen. In one embodiment, the remote control unit can also spontaneously give orders intended such that the user retrieves the same application from one room to the next. For example, if the user leaves, with his remote control unit, a first room in which the television is connected to a program, and if he enters a second room containing a television, the remote control unit may turn it on and switch it over to this same program. Location from one room to another can be ensured by the detection of transmitters fixed in each room, or else by more sophisticated means, of GPS type.

SUMMARY OF THE INVENTION

The present invention proposes to alleviate the drawbacks of the earlier devices, by proposing ergonomic control of changes of mode, which is much more intuitive than those of the prior art, and which can, in certain forms of embodiment of products according to such ergonomics, contribute to permanent visibility of the mode used, while ensuring autonomy and cost reduction.

In contradistinction to the earlier devices, the remote control according to the invention is not intended to bring about changes of mode when the user goes from one room to another, and is not concerned with the position of said user, but the change of mode is effected by movement of one part of the device with respect to the other, the change of mode activated according to the invention having on the contrary to be performed in one and the same room. Let us add that the device of the invention uses no communication with an information source, and requires no modification of the functionalities of the user interface.

Thus, the device for remote control according to the invention is one wherein said box is mounted movably in a support between a first position, corresponding to the first operating mode, and at least one second position, corresponding to the second operating mode and wherein it comprises means for detecting the position of the box, with respect to the support and means allowing modification of the operating mode as a function of the detected position of the box.

According to a complementary characteristic, the box is mounted movably in translation in the support.

According to another complementary characteristic, the means for detecting the position of the box, with respect to the support, comprise at least one sensor and the means allowing modification of the operating mode as a function of the detected position of the box comprise a processor.

The sensor may consist of a pushbutton or a magnetic breaker or a Hall-effect breaker.

In a preferred configuration, the box is elongate, of substantially parallelepipedal shape, whilst the support is for example a frame open at the top, having the shape of a U, so as to comprise a lower border, and two lateral borders, while the main box is mounted slidably in the central housing between the two lateral borders so as to be able to be moved from the first position to at least one second position.

Let us note that the box can be positioned in two positions corresponding to two modes of automatic operation, and in a position corresponding to a mode of manual operation, and conversely in two modes of manual operation, and in a single position corresponding to an automatic operating mode.

Let us add that, the device exhibits, advantageously, means for indexing the relative positions of the box with respect to the support. It has been understood that the box is mobile with respect to its support and removable with respect to the latter, so that it can be completely unhitched. The second position can be an unhitched position.

Other characteristics and advantages of the invention will emerge from the description which follows with regard to the appended drawings which are given merely by way of nonlimiting examples.

DESCRIPTION OF THE DRAWINGS

FIG. 1 represents the configuration of the remote control in its so-called automatic operating mode.

FIG. 2 represents the configuration of the remote control in its so-called manual operating mode.

Figure 1:
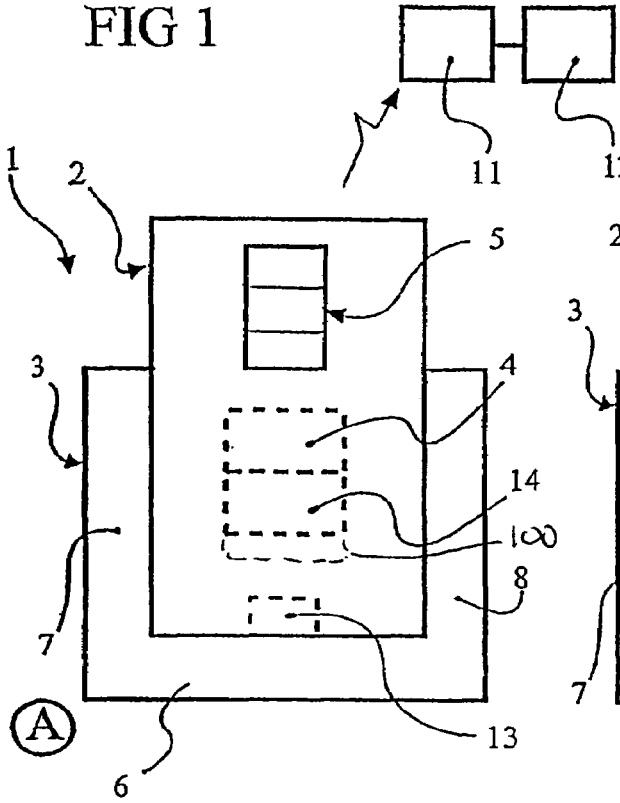
FIGS. 1 and 2 represent a diagrammatic face-on view of an example of the supervisory and remote control device in its two operating modes.

According to the invention, the remote control bearing the general reference (1) consists of two parts (2, 3), that can be moved with respect to one another. Thus, it comprises a main box (2) comprising at least one remote control transmitter (4) and a control keypad (5). Said main box (2) is mounted movably in translation in a support (3), which may serve as wall support, table or the like.

Let us note that the transmitter (4) is for example of the radio frequency type, while the control keypad (5), makes it possible to address orders to a receiver (11) of the installation, linked to a supervisory device (12).

Figure 2:
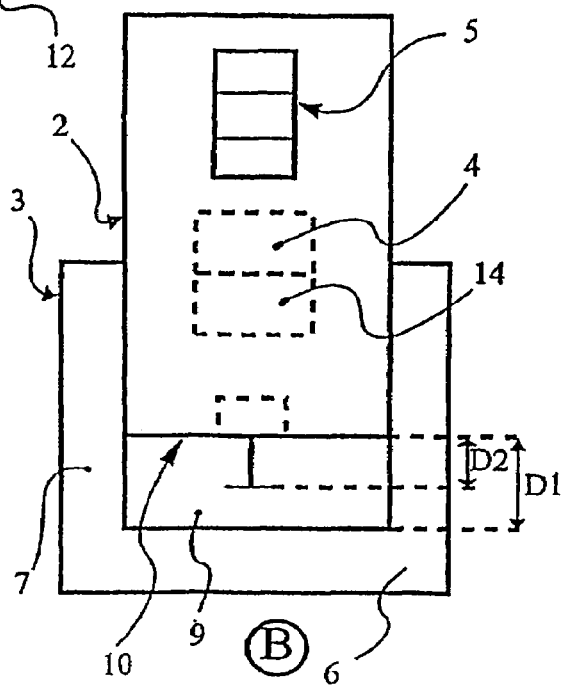

The box (2) is elongate, of substantially parallelepipedal shape, whilst the support (3) is for example a frame open at the top, having the shape of a U, so as to comprise a lower border (6), and two lateral borders (7, 8), while the main box (2) is mounted slidably in the central housing (9) between the two lateral borders (7, 8) so as to be able to be moved from a first position (A) such as illustrated in FIG. 1 to at least one second position (B) such as represented in FIG. 2.

In the first position (A), the remote control unit is in its automatic operating position and it is this operating mode that is activated, in the second position (B), it is the manual mode that is activated.

In the first position (A), the so-called automatic operating position, the main box (2) is in the bottom position in the reception housing (9), that is to say completely engaged in its support (3), so that the lower border (10) of said box is in contact with the lower border (6) of said support (3).

In the second position (B), the so-called manual operating position, the main box (2) is moved from its first position (A), upward by a distance (D1), so that its lower border (10) is separated from the lower border (6) of the support (3), so as no longer to be in contact with the latter border. It will be noted that this separation (D1) is unambiguously visible at a distance of a few meters, and the user can then ascertain whether his remote control is in the manual or automatic operating position.

According to the invention, the change of position is sufficient to make the supervisory device (12) go from a first mode to a second mode of operation. It has been understood that as soon as the box (2) has reached its separated position (B) of manual operation, this mode of operation no longer changes when the distance (D1) is increased. Thus, the user can, in so-called manual operation, either leave the box in its support, as illustrated in FIG. 2, or remove it completely so as to unhitch it from the support.

Of course the device comprises means for detecting the position of the box (2), with respect to the support (3). Thus, in its bottom part the box (2) comprises a sensor (13) linked to the processor (14), said sensor being intended to recognize whether the box is in the first position (A), or in the second position (B). It can also be enough to recognize only whether or not the box is in the first position (A).

The sensor (13) may be of any type, and for example a breaker, or even a simple pushbutton whose movable part is pressed by contact with the support (3) when the bottom part of the box (2) is in the position (A) as illustrated in FIG. 1. In this case the distance (D1) for going from the first position to the second position will be greater than the travel (D2) of the movable part of the pushbutton.

This form of embodiment of the sensor (13) will advantageously be replaced by a form, known to the person skilled in the art, requiring no drilling of the box. Thus, a flexible-reed magnetic breaker disposed on the same printed circuit as the processor (14) intended to be actuated at very short distance by a magnet (15) housed in the lower border (6) of the support (3) facing the location of the sensor (13) could be envisaged as sensor. A Hall-effect sensor could also be used.

Let us add that the box comprises means allowing modification of the operating mode as a function of the detected position of the box. Thus, the sensor (13) is linked to an input of the processor (14), for example to an interrupt input. It will be stated by convention that the sensor and this input are in the logic 1 state in the first position (A) and in the logic 0 state in the second position (B). Upon a change of state of such an input, the processor, possibly placed in idle mode to reduce its consumption, goes to active mode.

As also shown in FIG. 1, the box 2 of the remote control device may also include a clock 100 that allows the processor 14 of the remote control device to execute an automatic mode by sending orders at user-programmed times, which can be input, for example, using the keypad 5. The processor 14 can execute logic such that when it is sensed that the box 2 is in a first position (e.g., position A shown in FIG. 1, as sensed by the above-described sensor) relative the support 3, manipulation of the keypad 5 results in sending programming commands to the processor 14, for instance, the times at which the user desires preprogrammed commands to be sent to the controlled device 11. In contrast, when the box 2 is not in the first position (e.g., when it is in position B of FIG. 2), manipulation of the keypad 5 is interpreted by the processor 14 to represent commands to be sent immediately to the controlled device.

Alternatively, when the box 2 is in the first position relative to the support 3, the keypad 5 may be disabled, such that commands may be sent to the controlled device from the remote control only automatically at preprogrammed times. These preprogrammed times may be set into the remote control unit during manufacture, or they may be programmed using the keypad 5 when the box 2 is not in the first position and a special switch or button on the keypad 5 is depressed, indicating that the commands being entered on the keypad 5 are intended to program the remote control unit. In this embodiment, when the box 2 is removed from the first position, the automatic transmission of preprogrammed commands can be disabled, such that the only way to remotely control the controlled device is to manipulate the keypad 5 (with the special switch or button, if provided, being manipulated to indicate that the commands being entered on the keypad 5 are intended to move or otherwise command the controlled device).

Alternatively, when the box is in the first position some or all of the keys of the keypad 5 can remain active for sending or programming commands. In such an embodiment, the only difference in operation between the box being in the first position relative to the support and it not being in the first position is that some commands are automatically sent when the box is in the first position and are not automatically sent when the box is in other positions.

Figure 3:
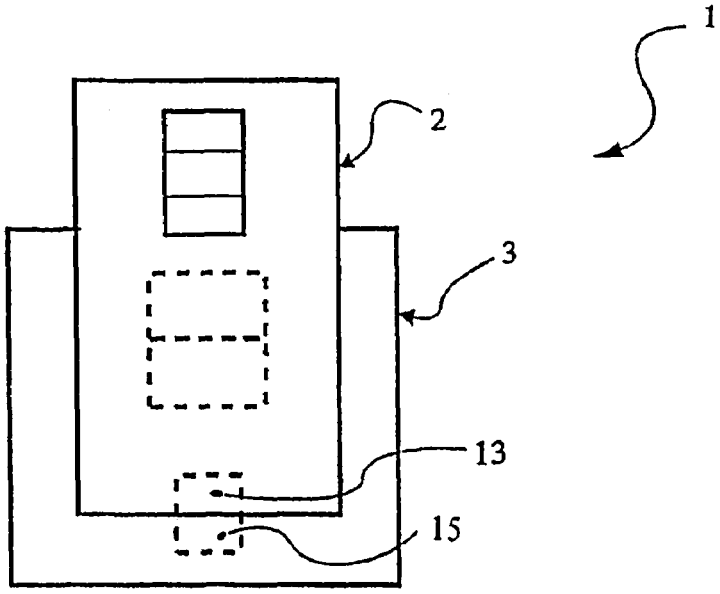
FIG. 3 is a view similar to FIG. 1, representing a variant execution of a position sensor.
Figure 4:
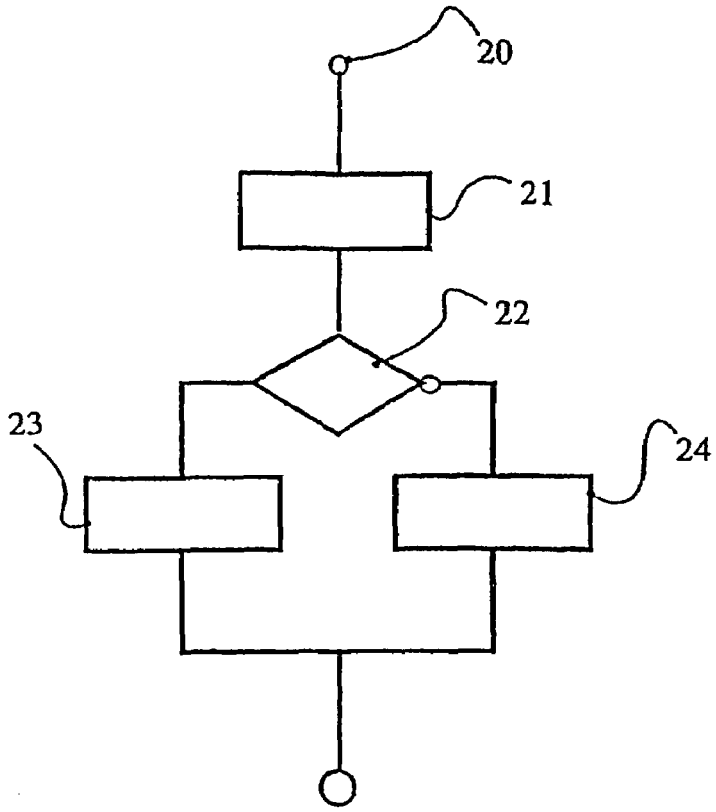
FIG. 4 is a schematic representation illustrating the organization of the means allowing modification of the operating mode as a function of the position of the box.

FIG. 3 represents a flow chart of the interrupt program activated on entry (20) by a change of state of the processor. The state of the sensor is read by the software module (21), then a test (22) is carried out to steer the program to the module (23) in the case of a 1 state or to the module (24) in the case of a 0 state. In the module (23), the processor is placed in the automatic mode. In the module (24), the processor is placed in the manual mode.

In the same way, the remote control unit itself may have its operating ergonomics modified by this change of mode.

Of course, the invention is not limited to the embodiment described above. Specifically, it is possible to contemplate for example several visually well-separated positions, for each of the operating modes. Thus, it would be possible to provide two positions corresponding to two modes of automatic operation, and a position corresponding to a mode of manual operation. Likewise, it would be possible to provide two positions corresponding to two manual modes of operation, and a single position corresponding to an automatic operating mode.

Figure 5:
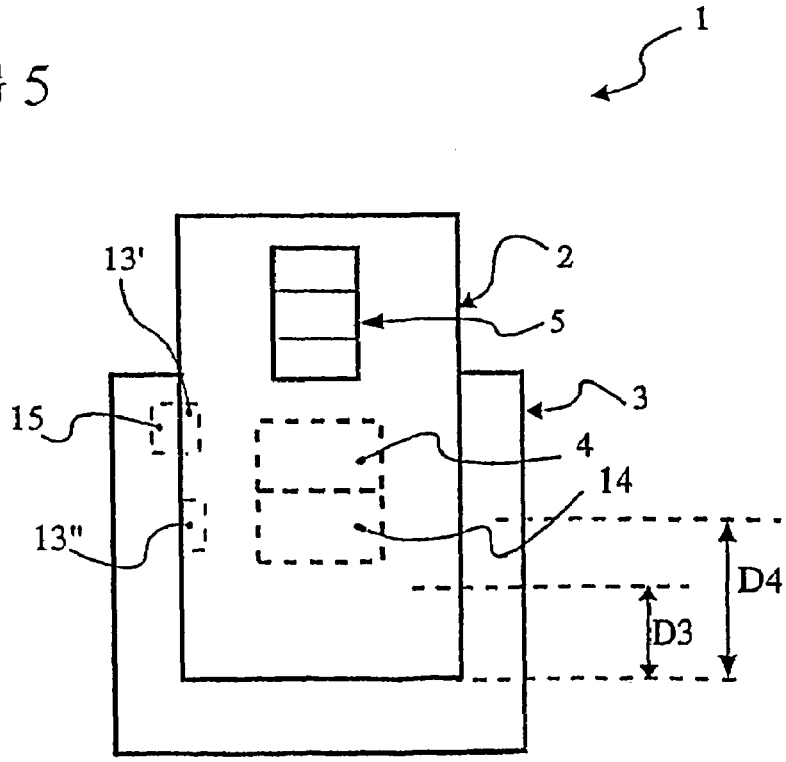
FIG. 5 represents a diagrammatic face-on view of a variant execution of the remote control.

FIG. 5 illustrates a variant execution, according to which three positions are envisaged for the box, which comprises two sensors (13', 13"), activated or otherwise by one and the same magnet (15).

In the completely engaged position, the sensor (13') is activated, a movement of height (D3) activates the sensor (13"), a movement of height equal to or greater than (D4) no longer activates any sensor.

Of course means for indexing the relative positions of the box (2) with respect to the support (3) may advantageously be provided, such as for example, projecting profiles disposed on the lateral walls of the box (2), which walls are intended to engage in corresponding recessed profiles made on the support (3), and then define stable and defined positions of the box in its support.

Described hereinabove was a support that can constitute a wall support, but said support (3) could have any other form and be for example a stand, intended to be placed for example on a desk without being fastened in a fixed and determined manner.

DESCRIPTION OF THE PREFERRED EMBODIMENT

According to the preferred mode of the invention the movement of the box with respect to the support is a translational motion, but it could be otherwise. Thus, a support on which the box is moved according to a rotational motion could be envisaged. Likewise, one would not be departing from the scope of the invention if the support were to comprise several housings (9) intended to receive the box. In this case, one of the housings could be dedicated to the first position corresponding to automatic operation, while a second housing could be dedicated to the second position corresponding to manual operation. What is important is that the various positions of the box be visually well-identifiable and intuitively best convey the operating mode in progress.

Of course, the invention is not limited to the embodiments described and represented by way of examples, but it also comprises all technical equivalents as well as their combinations.

The invention claimed is:

1. A device for controlling a controlled device, comprising:

at least one remote control unit, the remote control unit including at least one remote control transmitter, at least one processor, and a control keypad;

at least one support, the remote control unit being removably engageable in the support; and means for detecting whether the remote control unit is in a first position relative to the support, and wherein, when the remote control unit is in the first position relative to the support, manipulations of the keypad result in sending programming commands to the processor such that the processor can transmit control signals to the controlled device at user-defined times, and when the remote control unit is not in the first position relative to the support, at least one of said manipulations of the keypad causes the transmitter to send commands to the controlled device.

2. The device of claim 1, wherein the remote control unit is mounted movably in translation in the support.

3. The device of claim 1, wherein the means for detecting is selected from the group consisting of: pushbuttons, magnetic breakers, optical sensors, and Hall-effect breakers.

4. The device of claim 1, wherein the controlled device is selected from the group consisting of window coverings, awnings, screens, HVAC systems, openable panels, dynamic solar protection systems, and lighting systems.

5. A device for controlling a controlled device, comprising:

at least one remote control unit, the remote control unit including at least one remote control transmitter, at least one processor, and a control keypad;

at least one support, the remote control unit being removably engageable in the support;

means for detecting whether the remote control unit is in a first position relative to the support, wherein, when the remote control unit is in the first position relative to the support, an automatic mode is executed, such that commands may be sent to the controlled device from the device automatically at preprogrammed times.

6. The device of claim 5, wherein when the remote control unit is not in the first position, automatic transmission of preprogrammed commands from the processor is disabled, such that the only way to remotely control the controlled device using the device is to manipulate the keypad.

7. The device of claim 5, wherein the controlled device is selected from the group consisting of window coverings, awnings, screens, HVAC systems, openable panels, dynamic solar protection systems, and lighting systems.

8. The device of claim 5, wherein the means for detecting is selected from the group consisting of: pushbuttons, magnetic breakers, optical sensors, and Hall-effect breakers.

9. A device for controlling a controlled device, comprising:

at least one remote control unit, the remote control unit including at least one remote control transmitter, at least one processor, and a control keypad;

at least one support, the remote control unit being removably engageable in the support;

means for detecting whether the remote control unit is in a first position relative to the support, wherein some commands are automatically sent when the remote control unit is in the first position relative to the support, and wherein these commands are not automatically sent when the remote control unit is not in the first position relative to the support.

10. The device of claim 9, wherein when the remote control unit is not in the first position, automatic transmission of preprogrammed commands from the processor is disabled, such that the only way to remotely control the controlled device using the device is to manipulate the keypad.

11. The device of claim 9, wherein the controlled device is selected from the group consisting of window coverings, awnings, screens, HVAC systems, openable panels, dynamic solar protection systems, and lighting systems.

12. The device of claim 9, wherein the means for detecting is selected from the group consisting of: pushbuttons, magnetic breakers, optical sensors, and Hall-effect breakers.

* * * * *